US008840328B2

(12) United States Patent
Hoshino

(10) Patent No.: US 8,840,328 B2
(45) Date of Patent: Sep. 23, 2014

(54) PRINTING APPARATUS AND METHOD FOR CONVEYING PRINTING MEDIUM

(75) Inventor: Ken Hoshino, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/571,796

(22) Filed: Aug. 10, 2012

(65) Prior Publication Data

US 2013/0045038 A1 Feb. 21, 2013

(30) Foreign Application Priority Data

Aug. 19, 2011 (JP) ..... 2011-179782

(51) Int. Cl.
*B41J 11/00* (2006.01)
*B41J 3/60* (2006.01)

(52) U.S. Cl.
CPC ..... *B41J 3/60* (2013.01)
USPC ..... 400/582; 399/309; 399/364; 399/388; 399/401; 271/291

(58) Field of Classification Search
USPC ..... 400/582; 399/309, 364, 388, 401; 271/291
See application file for complete search history.

(56) References Cited

U.S. PATENT DOCUMENTS 5,135,215 A * 8/1992 Takimoto et al. ..... 271/301
7,431,282 B2 10/2008 Ohama
7,984,908 B2 * 7/2011 Chan et al. ..... 271/291
2003/0209852 A1 * 11/2003 Choi ..... 271/291
2004/0207708 A1 10/2004 Ohashi et al.
2010/0296856 A1 11/2010 Moriyama

FOREIGN PATENT DOCUMENTS

CN 1539647 A 10/2004
CN 101891079 A 11/2010
JP 10-245140 9/1998
JP 10245140 A 9/1998
JP 2003-280294 10/2003
JP 2003280294 A 10/2003
JP 2004299867 A 10/2004
KR 20060061562 A 6/2006

OTHER PUBLICATIONS

Official Communication, dated Jan. 2, 2013, issued by the European Patent Office, in European Patent Application No. 12005926.6.
Chinese Office Action issued in Chinese Application No. 201210297390.4 dated Jun. 5, 2014.

* cited by examiner

*Primary Examiner* — Matthew G Marini
*Assistant Examiner* — Allister Primo
(74) *Attorney, Agent, or Firm* — Fitzpatrick, Cella, Harper & Scinto

(57) ABSTRACT

When a size of a reversing unit is smaller than that of a printing medium, errors can be detected without adding any other mechanism, and if such errors are not caused by a paper jam, the printing can be continued. A printing apparatus is provided with: an reversing unit provided with an reversing roller; a sensor ; and a control unit configured to, if when the detecting unit detects a load equal to or more than a predetermined value, a conveyance amount of the printing medium after the sensor has detected the fore end is longer than a threshold value that is a distance from a position of the fore end at the time of being detected by the sensor to a position of the fore end at the time of exiting from the conveyance path of the reversing unit, perform control to continue conveyance.

5 Claims, 13 Drawing Sheets

PRIOR ART

PRIOR ART

PRIOR ART

| FIG.9A | FIG.9B |
|---|---|

PRINTING APPARATUS AND METHOD FOR CONVEYING PRINTING MEDIUM

BACKGROUND OF THE INVENTION

1. Field of the Invention

This invention relates to a printing apparatus and a method for conveying a printing medium, and in particular, to a printing apparatus that has a printing medium reversing unit for reversing a printing medium to perform two-sided printing on the printing medium, and a method for conveying such a printing medium.

2. Description of the Related Art

A printing apparatus for two-sided printing on a printing medium is generally provided with a printing medium reversing unit for reversing the printing medium.

FIGS. 1 and 2 are schematic diagrams illustrating a schematic configuration of a conventional printing apparatus, and with use of the diagrams, reversing operation of a printing medium P is briefly described.

The printing apparatus has a printing medium stack 1 for stacking the printing medium P thereon, and a feeding roller 2 for feeding out the printing medium P from the printing medium stack 1. The printing medium P fed out from the printing medium stack 1 then reaches a first conveying roller 10 via a PE sensor 20, where the printing medium P is continued to be conveyed. (Note that although the term "roller" described hereinafter refers to a configuration of a "roller pair" provided with a roller driven by a drive source and a driven roller for nipping and conveying the printing medium P in corporation with the roller, for convenience, this configuration is simply referred to as a "roller" to provide the description below. The conveyed printing medium P is then conveyed to a printing area opposing a printing head 4, where printing is performed on the printing medium P, which is then discharged to a discharge tray by a discharge roller 12.

The two-sided printing will now be described with additional reference to FIG. 3. The printing medium reversing unit R includes a loop path, on which a first reversing roller 21 and second reversing roller 22 are provided. For the exemplary device configuration illustrated in FIGS. 1 and 2, the printing medium reversing unit R is located upstream of the printing area with respect to a printing medium conveying direction for printing.

After the printing has been performed on a first side of the printing medium P, the rotation of a motor is reversed to reverse rotation of the first and second conveying rollers 10 and 11 (step S001). When reverse rotation and conveyed to a branch A denoted by a symbol A in FIG. 1, the printing medium P is conveyed from the branch A to the printing medium reversing unit configured as the loop path. FIG. 2 indicates that the fore end of the printing medium P has again reached around the branch A via the printing medium reversing unit R. By passing through the printing medium reversing unit R, printing can be performed on a second side of the printing medium P, which is the back side of the first side on which the printing has been completed. For the inversed printing medium P, the PE sensor 20 detects whether or not the printing medium P has reached the position of the PE sensor 20 (step S003). After the PE sensor 20 has detected that the printing medium P has reached there, it is further determined whether or not the printing medium P has reached a normal rotation position of the first conveying roller 10 (step S004), and if it is identified that the printing medium P has reached the position, the first and second conveying rollers 10 and 11 are rotated in normal direction (step S005) and successfully terminated. Then, printing is performed on the second surface of the printing medium P conveyed to the printing area via the first conveying roller 10, and the printing medium P is discharged to the discharge tray to complete the printing process.

On the other hand, when the drive source (or driving motor, not shown) providing driving force to the first and second reversing rollers 21 and 22 is overloaded and a servo error occurs (step S002) while the printing medium P is passing through the printing medium reversing unit R, the rotation of the driving motor is stopped to suspend the reversing rollers 21 and 22 (step S006). Then, it is determined that the servo error is caused by a paper jam, and a paper jam error is notified (step S007), resulting in error termination.

Japanese Patent Laid-Open No. H10-245140(1998) discloses a technique that detects a paper jam error when target and actual positions of the fore end of a printing medium are misaligned at a reversing unit for reversing the printing medium. In this technique disclosed in Japanese Patent Laid-Open No. H10-245140(1998), if a higher sliding load acts on reversing rollers to cause an overload on a motor for rotating the reversing rollers, it is then determined that there exists a paper jam error, and the motor is stopped.

In a printing apparatus described above having such a printing medium reversing unit, if the size of the printing medium is relatively larger than that of the printing medium reversing unit, the paper jam error might occur caused by the fore end and back end of the printing medium contacting each other. For saving space and downsizing the apparatus, for example, the above reversing unit may also be designed small. Such downsizing the printing medium reversing unit makes shorter a path for conveying a printing medium in the printing medium reversing unit. As a result, the fore end of the printing medium P having passed the loop path can jostle at the exit of the path (i.e., branch A) with an area containing its back end (the back end surface) before passing the path. Since the printing medium P is still continued to be conveyed, the fore end contacting on the back end surface is sometimes almost brought in the direction of conveying the back end surface of the printing medium P by friction and cannot exit from the loop path of the printing medium reversing unit. This situation causes abnormal rotation of the first and second reversing rollers 21 and 22 to overload the driving motor.

The technique disclosed in Japanese Patent Laid-Open No. H10-245140(1998) cannot discriminate errors caused by so-called the paper jams from those by the jostling of the fore end and back end area (back end surface) of the printing medium and determines the both cases as paper jam errors. Therefore, the printing operation must be terminated to perform paper jam fixing operations in that case, lowering the throughput and usability of the printing apparatus.

On the other hand, Japanese Patent Laid-Open No. 2003-280294, aiming to prevent paper jams caused by the jostling of the fore end and back end of the same long two-sided paper conveyed on a path, discloses a mechanism for separating driven rollers of rollers from each other on an reversing path while the paper being reversed, thereby preventing the jostling of the fore end and back end of the paper.

Applying the technique disclosed in Japanese Patent Laid-Open No. 2003-280294 to a printing apparatus enables continuing printing operations because, even when the fore end and back end of a printing medium jostle with each other, there is no load fluctuation on a drive motor and no servo error is detected. Therefore, the throughput of the printing operations does not decrease; however, additional mechanism is needed for separating driven rollers of rollers from each other at a reversing unit, complicating the entire mechanism of the printing apparatus. As a result, its original purpose of making the printing apparatus smaller and thinner cannot be accomplished.

SUMMARY OF THE INVENTION

It is therefore an aim of the present invention to provide a printing apparatus and method for conveying a printing medium that, when the size of a printing medium reversing unit (length of a loop path) is smaller (or shorter) compared with that (the maximum length) of the printing medium, can determine whether the detected load fluctuation of the drive motor was caused by the paper jams or the contact of the printing medium, and if it was caused by the contact of the printing medium case, can continue the printing.

In order to accomplish the above aim, the invention is a printing apparatus that uses a print head to perform printing on a printing medium, and provided with: an reversing unit that, after conveyance for printing on a first surface of the printing medium has been completed, reverses the printing medium in order to perform printing on a second surface, which is a back surface of the first surface, and is provided with an reversing roller for conveying the printing medium to a conveyance path of the reversing unit; a sensor that is provided between a printing surface where the printing on the printing medium is performed and the reversing unit, and detects a fore end of the printing medium; a unit configured to, when the printing medium is conveyed through the reversing unit, detect a load on the reversing roller; and a control unit configured to, if when the detecting unit detects a load equal to or more than a predetermined value, a conveyance amount of the printing medium after the sensor has detected the fore end is longer than a threshold value that is a distance from a position of the fore end at the time of being detected by the sensor to a position of the fore end at the time of exiting from the conveyance path of the reversing unit, perform control to continue conveyance.

According to the above configuration, it can be determined whether a higher sliding load on the reversing roller located in the reversing unit and thereby a load placed on a motor driving the reversing roller are caused by a paper jam or a jostling between the fore end and back end area of the printing medium. As a result, if a jostling between the fore end and back end area of the printing medium, printing can be continued.

Further features of the present invention will become apparent from the following description of exemplary embodiments with reference to the attached drawings.

DESCRIPTION OF THE EMBODIMENTS

Various embodiments according to the invention will now be described below with reference to the drawings.

First Embodiment

The present inventors have found that, even when it is determined that the driving motor is overloaded by the reverse operation of the printing medium for two-sided printing, if the fore end of the printing medium have reached near the termination (exit) of an reversing path, then the suspension of conveying the printing medium P lowers slightly downward the fore end in the gravity direction, so that the contact of the fore end on the printing medium P can be removed. The removal of the contact of the fore end on the back end surface of the printing medium can also remove the cause of the load on the driving motor. As a result, normal conveying operation can be performed afterwards, such that the fore end of the printing medium can reach the PE sensor. Therefore, it can continue to perform printing operation on the back surface (second surface).

The conveyance control based on the above findings will now be described below with reference to the drawings.

FIGS. 4 to 8, 10, and 11 are schematic diagrams illustrating a schematic configuration of a printing apparatus according to the embodiment. Also, FIGS. 9A and 9B are flowcharts illustrating flows of conveyance control according to the embodiment. Further, FIG. 12 is a block diagram illustrating the control of the printing apparatus according to the embodiment.

Figure 1:
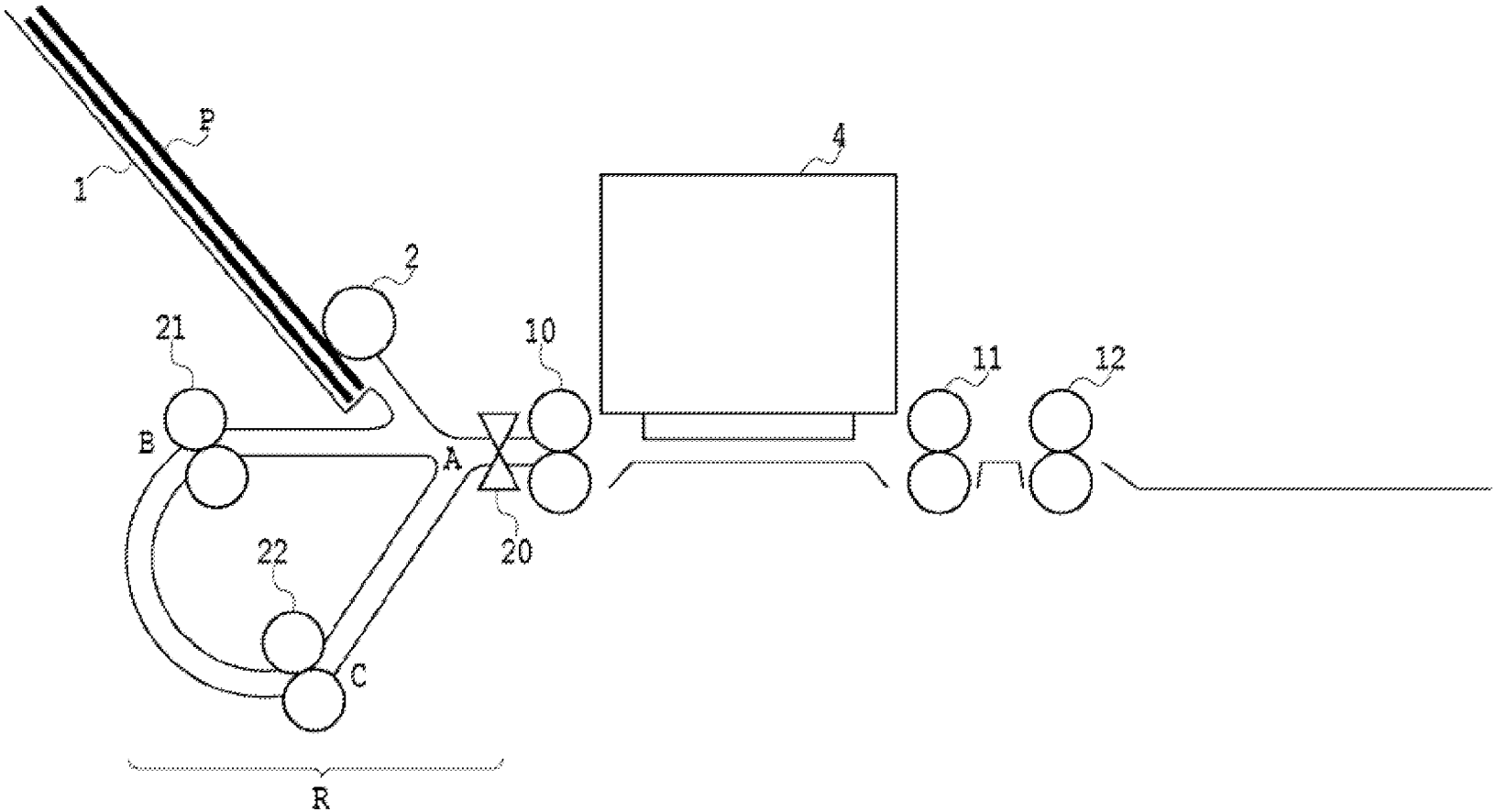
FIG. 1 is a diagram for describing reversing operation of a printing medium in a conventional printing apparatus.
Figure 2:
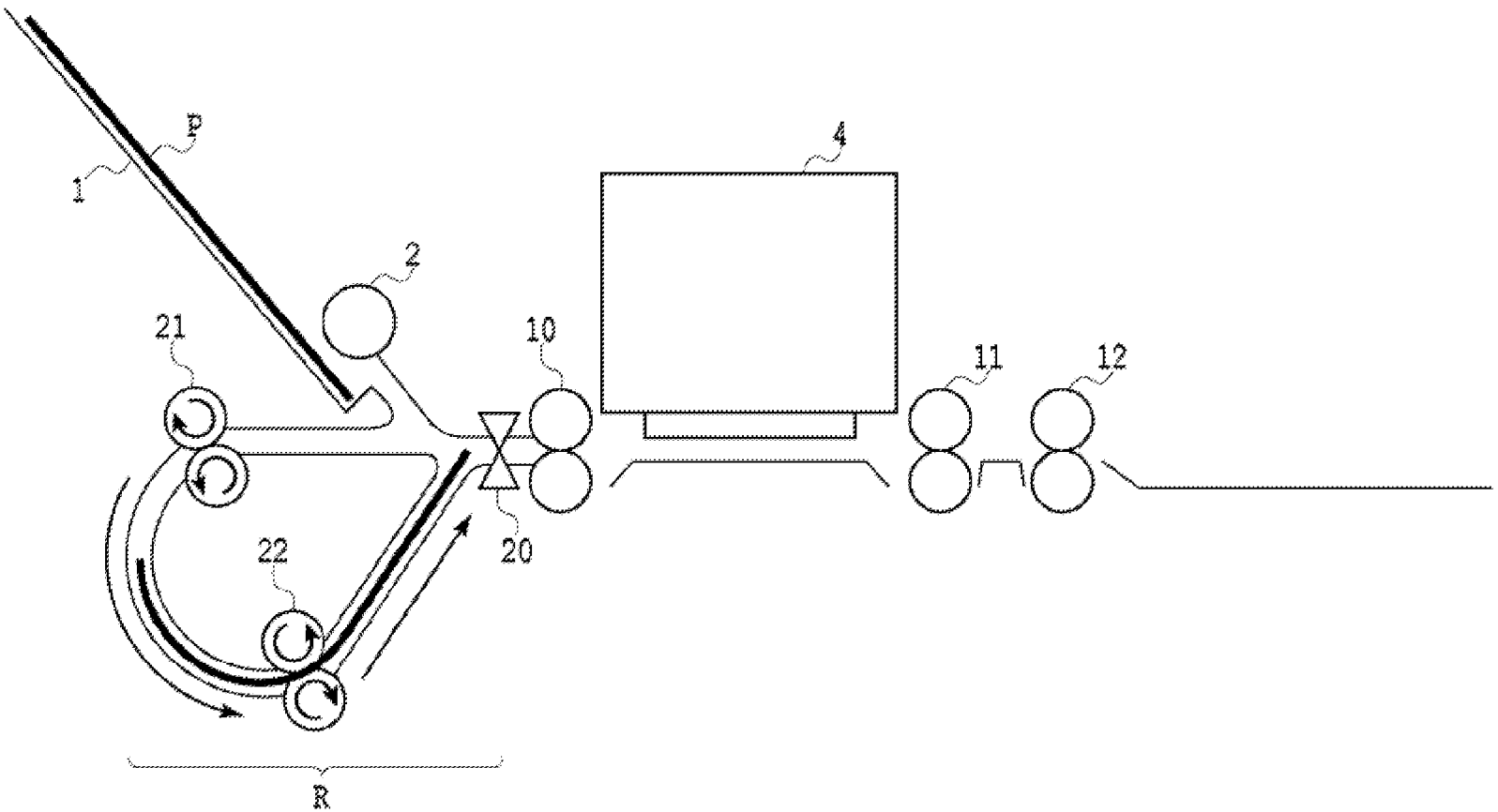
FIG. 2 is a diagram for describing reversing operation of a printing medium in a conventional printing apparatus.
Figure 3:
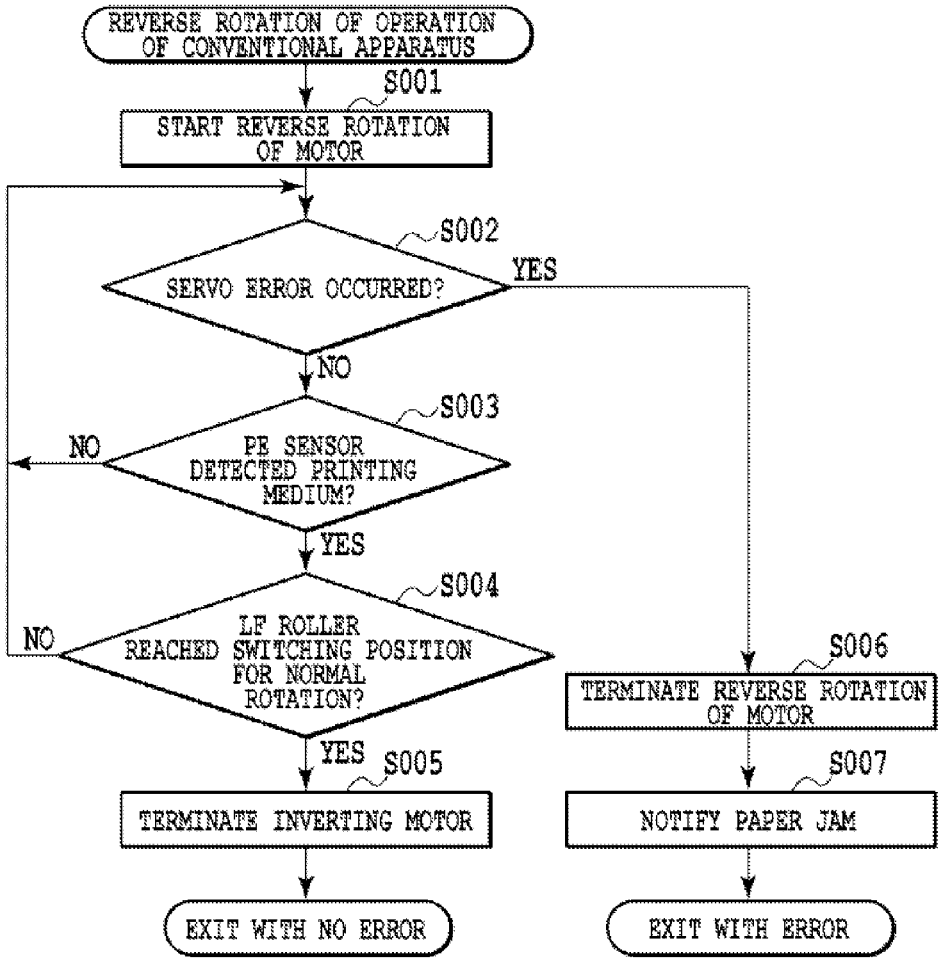
FIG. 3 is a flowchart illustrating a flow of conventional conveyance control.

In the description below, only the features of the invention and the difference between the printing apparatus of the invention and that described in the background will be set forth, as the basic configurations of the printing apparatus and the conveying operation of the printing medium P are equivalent to those described in FIGS. 1 and 2.

Figure 4:
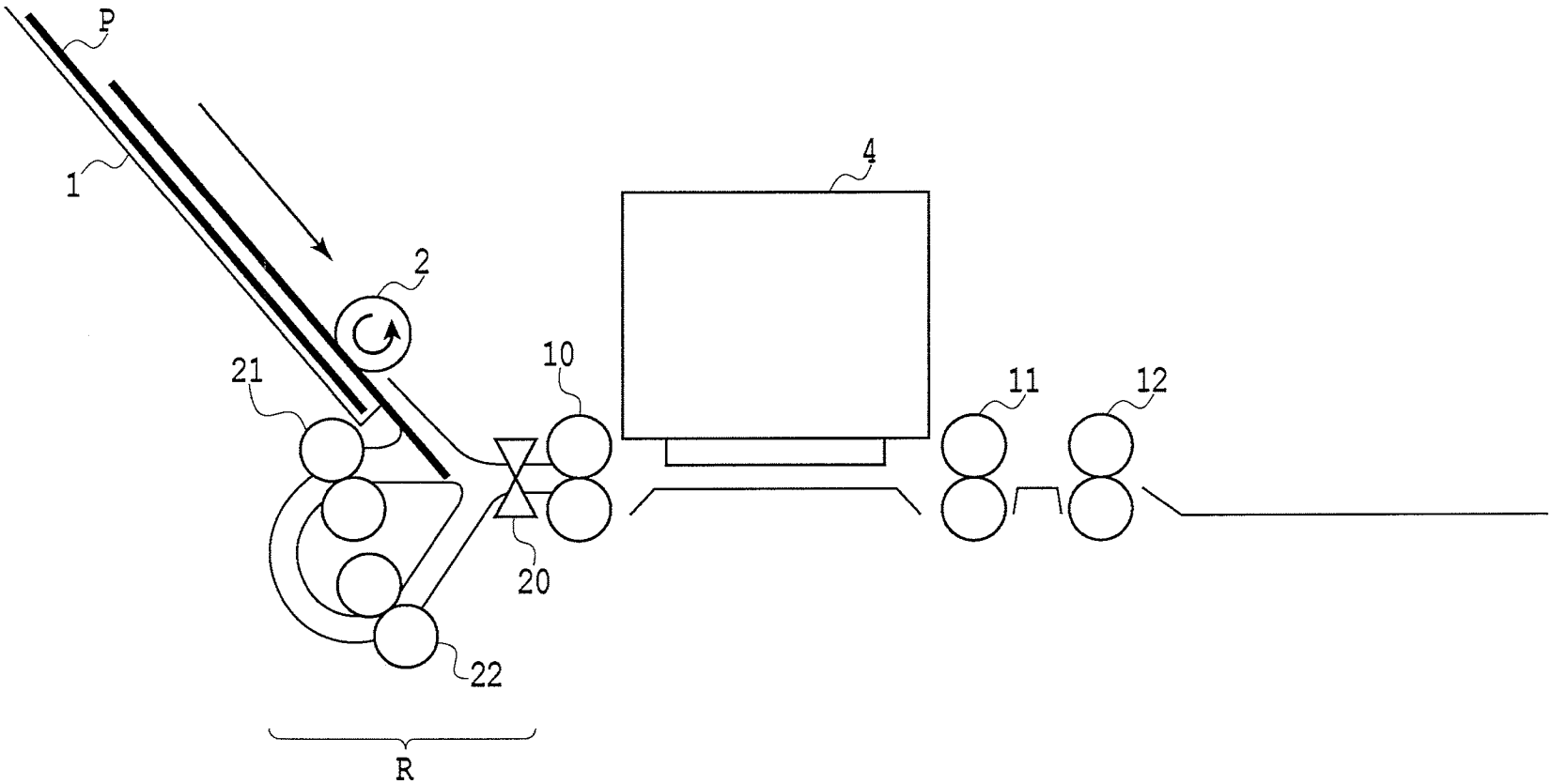
FIG. 4 is a diagram for describing reversing operation of a printing medium in a printing apparatus according to the first embodiment.

As illustrated in FIG. 4, the printing medium reversing unit of the printing apparatus for the printing medium that is made smaller and thinner has its shorter reversing path (loop path). For example, even if the printing apparatus allows for the printing on an A4-sized printing medium, the loop path length of the printing medium reversing unit is configured shorter than the length of the long side of the printing medium.

FIG. 4 shows that one of the printing media P is being separated and conveyed from the printing medium stack 1 with the feeding roller 2. After the fore end of the printing medium P has reached the first conveying roller 10, the roller 10 is rotationally driven to convey the printing medium P to a printing area opposing the printing head 4. Platens are provided on the printing area. The printing is performed on the first surface (front surface) of the printing medium conveyed on the platens. After the printing has completed, the rotation of the first and second conveying rollers 10 and 11 are reversed.

Figure 6:
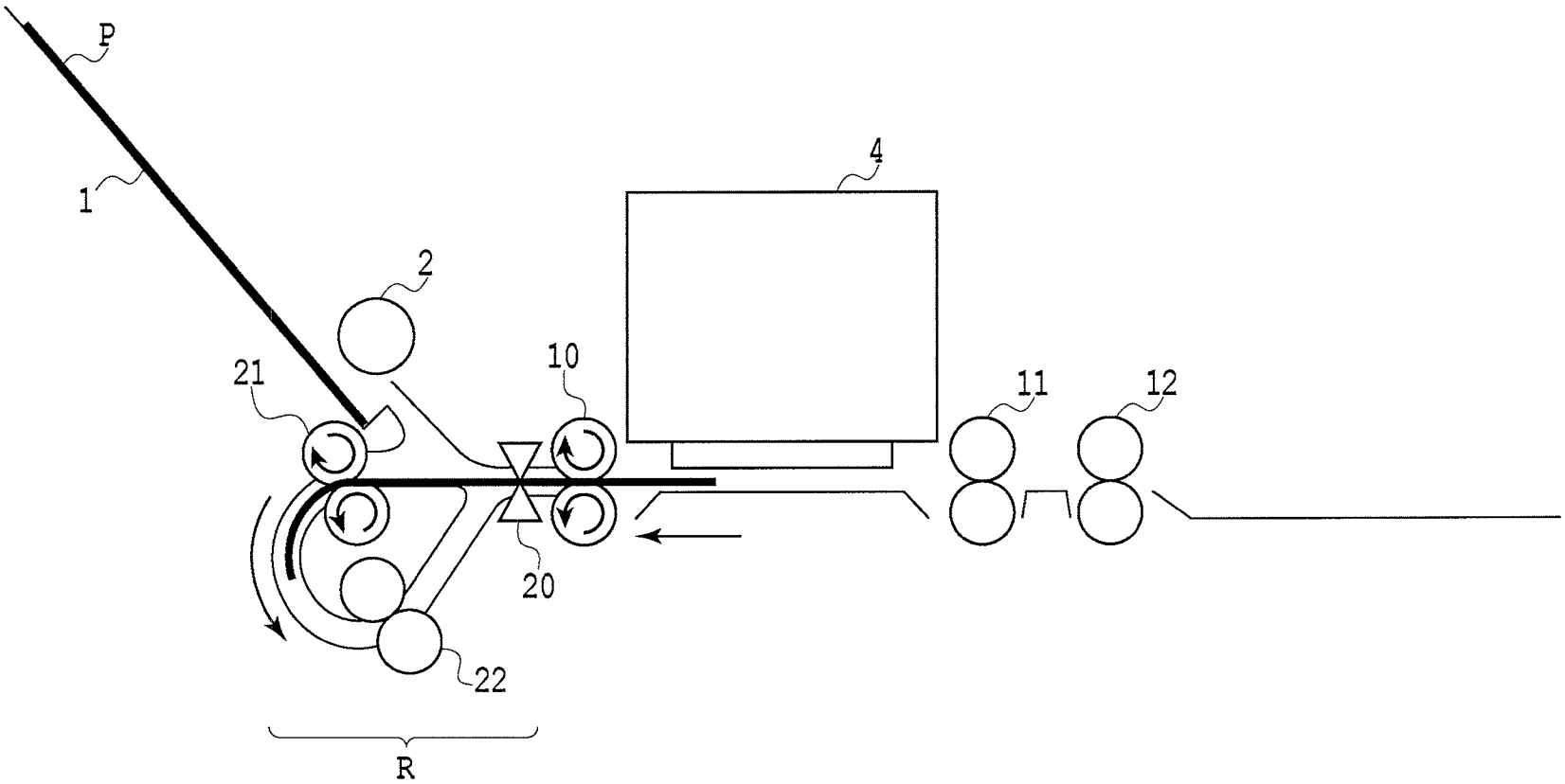
FIG. 6 is a diagram for describing reversing operation of a printing medium in a printing apparatus according to the first embodiment.
Figure 8:
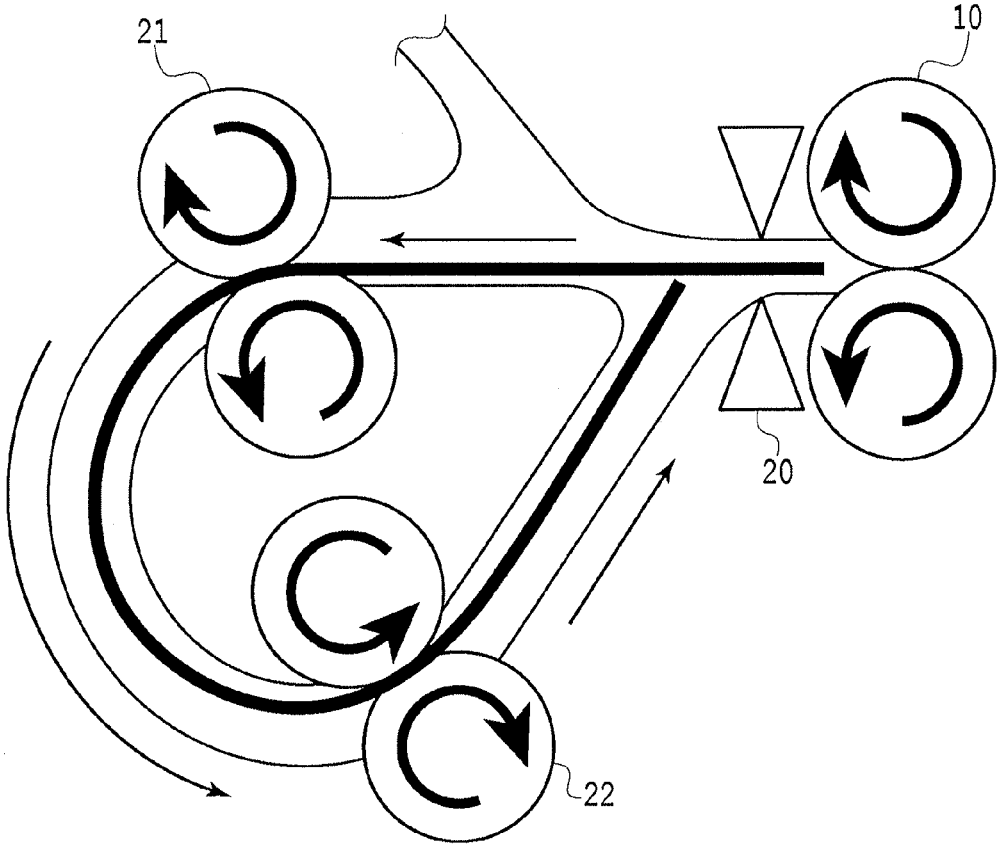
FIG. 8 is a diagram for describing reversing operation of a printing medium in a printing apparatus according to the first embodiment.
Figures 9, 9A:
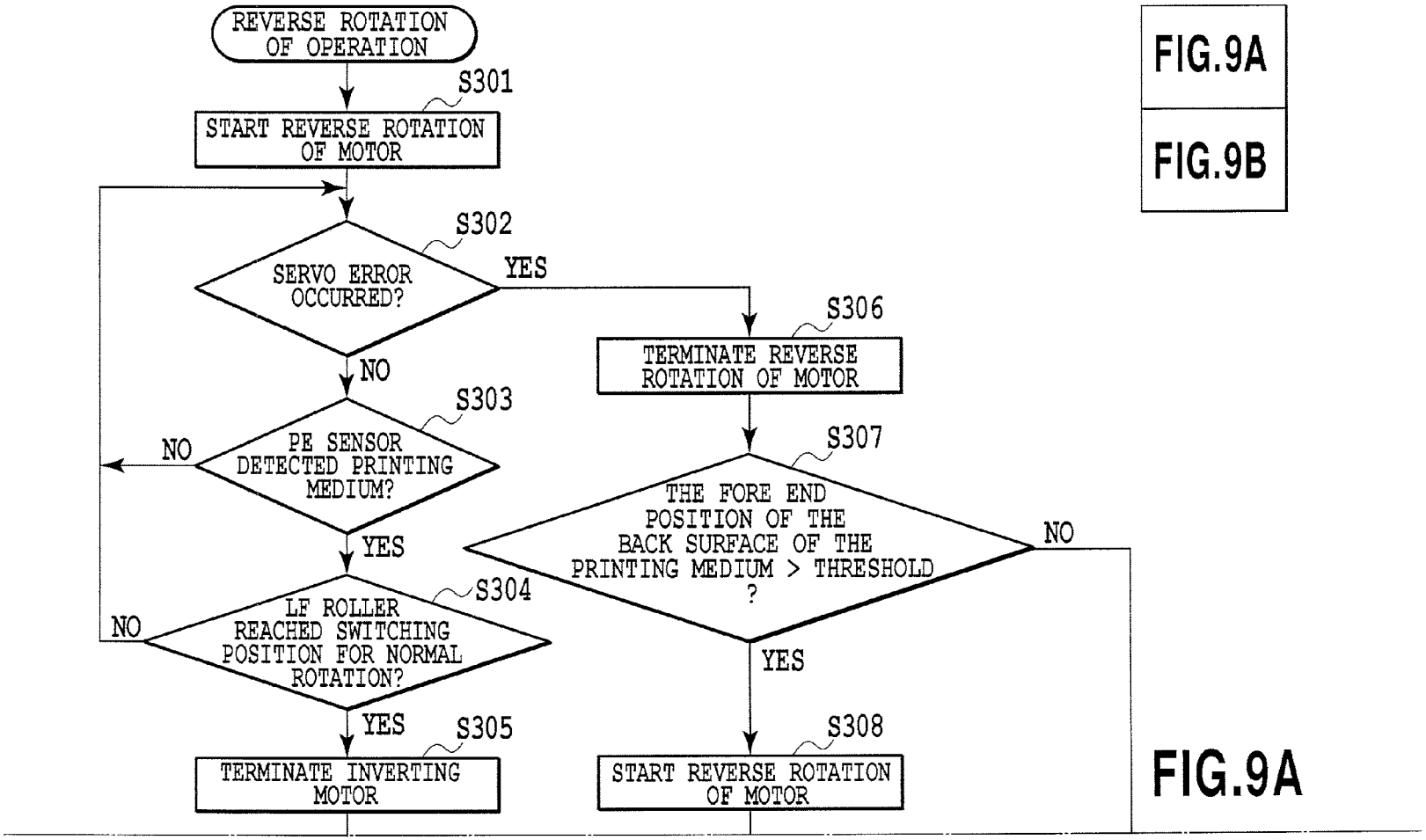
FIG. 9 is a diagram showing the relationship of FIGS. 9A and 9B.
FIGS. 9A and 9B are flowcharts illustrating flows of conveyance control according to the first embodiment.
Figure 9B:
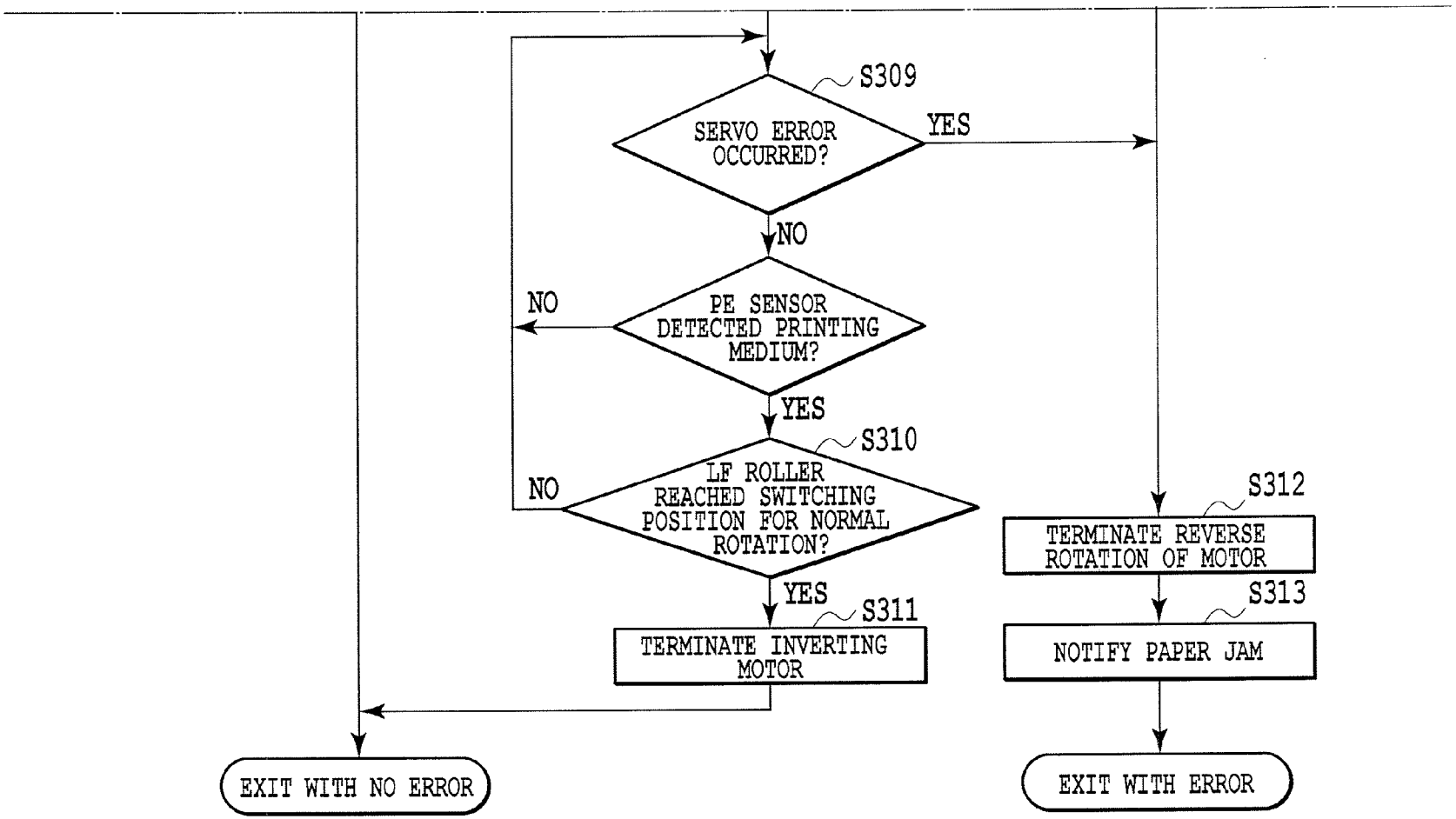

FIG. 8 shows that the rotation of the first and second conveying rollers 10 and 11 has been reversed. The printing medium P is conveyed to the reversing unit as illustrated in FIG. 6 in the opposite direction of conveying when printing on the first surface. The first and second reversing rollers 21 and 22 are provided within the reversing unit. The printing medium P having reached the reversing unit is conveyed by the reversing rollers on the looped reversing path.

Figure 7:
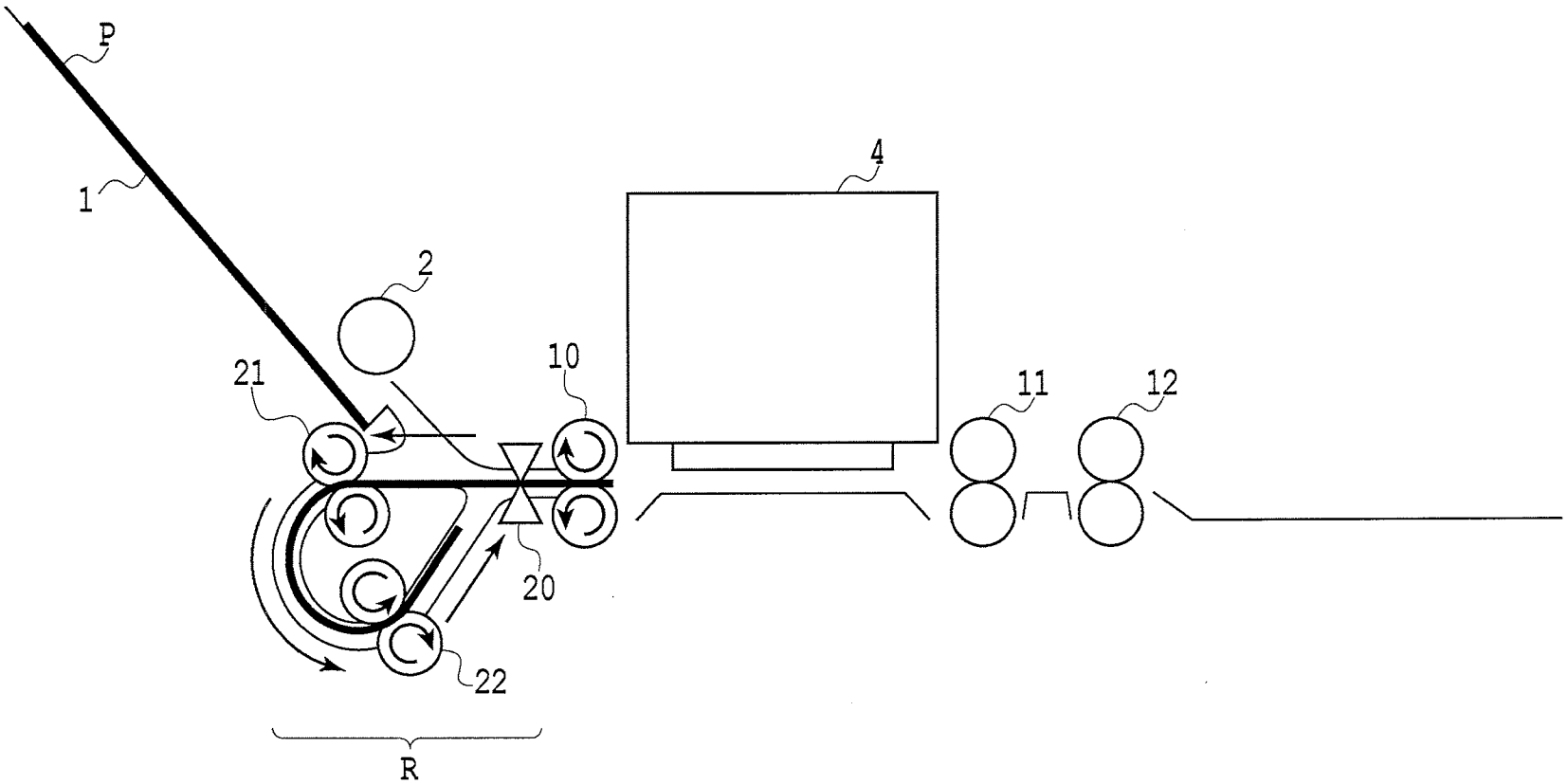
FIG. 7 is a diagram for describing reversing operation of a printing medium in a printing apparatus according to the first embodiment.

FIG. 7 shows that the A4-sized printing medium P is being conveyed within the printing medium reversing unit with its loop path length being shorter than that of the long side of the printing medium P, for example. The fore end of the printing medium P has been conveyed near the exit of the path and is on the verge of jostling with the area including the back end (back end surface) before passing the loop path.

FIG. 8 shows a schematic diagram enlarging the reversing unit R of the printing apparatus and illustrates that the printing medium P has been further conveyed from the position illustrated in FIG. 7. If the printing medium is further conveyed from there, the fore end of the printing medium P having passed the loop path would jostle with its back end surface at the exit (branch A) of the path. The conveyance of the printing medium P will be continued even when the fore end and back end surface of the printing medium being jostled with each other, so the fore end contacting on the back end surface would be prevented from being conveyed by the back end surface, causing an overload on the rotation of the second reversing roller 22 (and as a result, also on the driving motor).

The prevention of conveying the fore end of the printing medium P also restricts the rotation of the first reversing roller 21, causing an overload on the driving motor and servo errors.

The invention has features in post-processes after the servo errors have occurred.

FIGS. 9A and 9B are flowcharts illustrating flows of conveyance control according to the embodiment.

Figure 5:
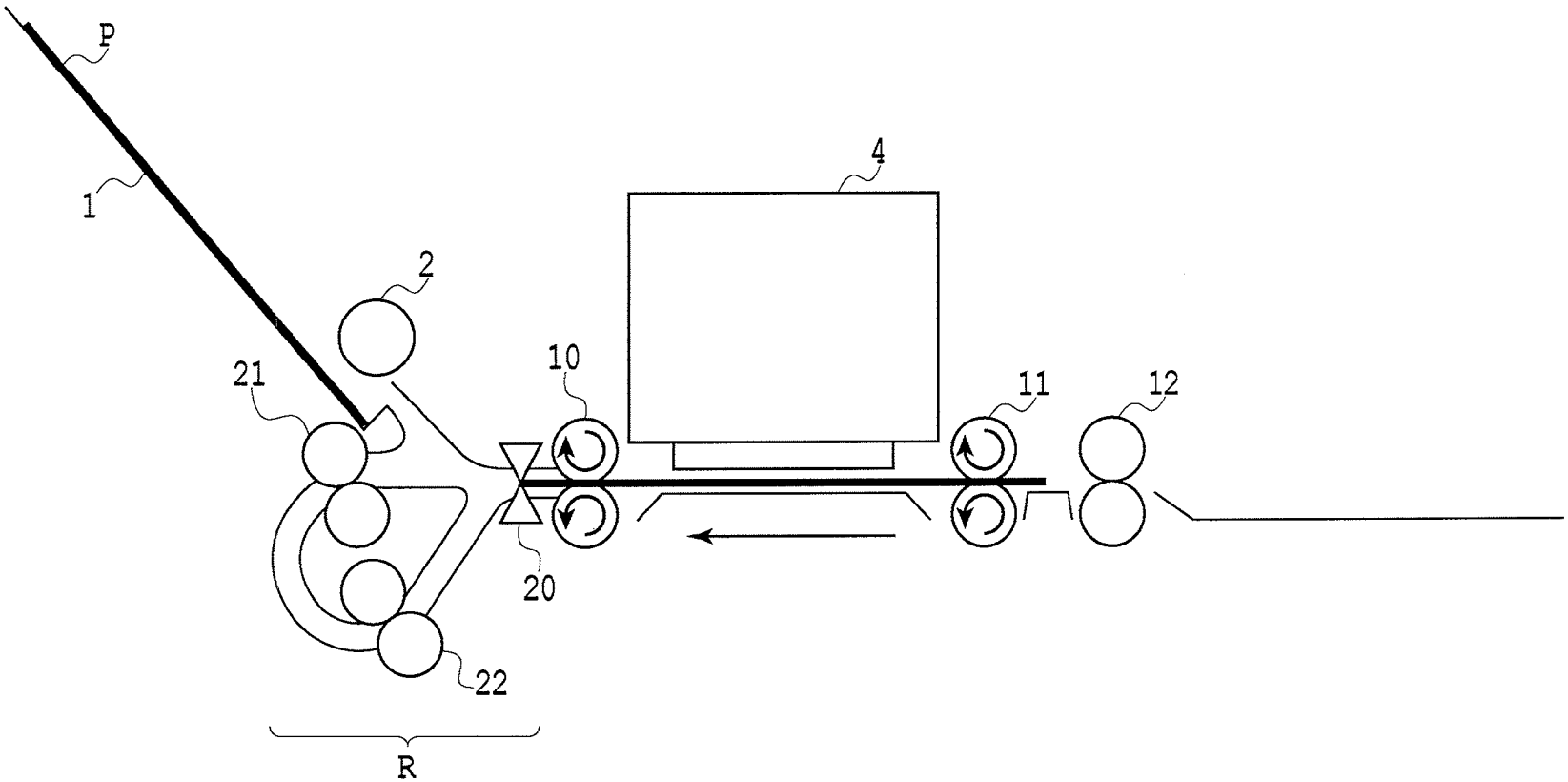
FIG. 5 is a diagram for describing reversing operation of a printing medium in a printing apparatus according to the first embodiment.

For reverse-printing on the printing medium, the motor is reversed to reversely rotate the first and second conveying rollers 10 and 11 in order to reversely convey the printing medium P as illustrated FIG. 5 (step S301). The load on the motor driving the rollers 21 and 22 is then monitored during the reverse operation of the printing medium P at the reversing unit. If it is determined that a load higher than a predetermined value acts on the motor and servo error occurs (step S302), the motor would be stopped (step S306).

The position of the fore end of the printing medium P on stopping the motor is then determined. An encoder detects the position based on the point where the fore end has passed the PE sensor 20 for the reverse operation. Note that a counter value of the encoder is stored as a threshold in the printing apparatus, which is obtained by converting the length (distance) from the position of the PE sensor 20 to that of around the exit via the minimum inner periphery of the loop path defining the reversing unit (or the estimated length that the printing medium is conveyed on the conveying path of the printing medium reversing unit and fore end of the printing medium is contact its back end surface). Note that the threshold may be defined by experiment, for example.

The threshold is compared with the counter value of the encoder for identifying the position of the fore end of the printing medium P. If the threshold is larger than or equal to the counter value, it can be determined that the fore end has reached the exit (or it is contacting the back end surface of the printing medium P). In other words, it can be determined that the heightened load on the motor was not caused by a paper jam of the printing medium P.

In this case, rotating the driving motor again allows for continuing the conveyance of the printing medium P (step S308). In this embodiment, the interval between stopping the motor (step S306) and rotating it again (step S308) is about 10 milliseconds. Therefore, the temporal delay has almost no effect on the conveyance.

Note that if no servo error occurred at step S302, when the printing medium is conveyed to the PE sensor (step S303), the rotation of the conveying roller 10 is switched from reverse rotation to normal rotation (step S305) to finish the conveying operation normally. The printing on the back surface (second surface) of the printing medium is then performed.

Figure 10:
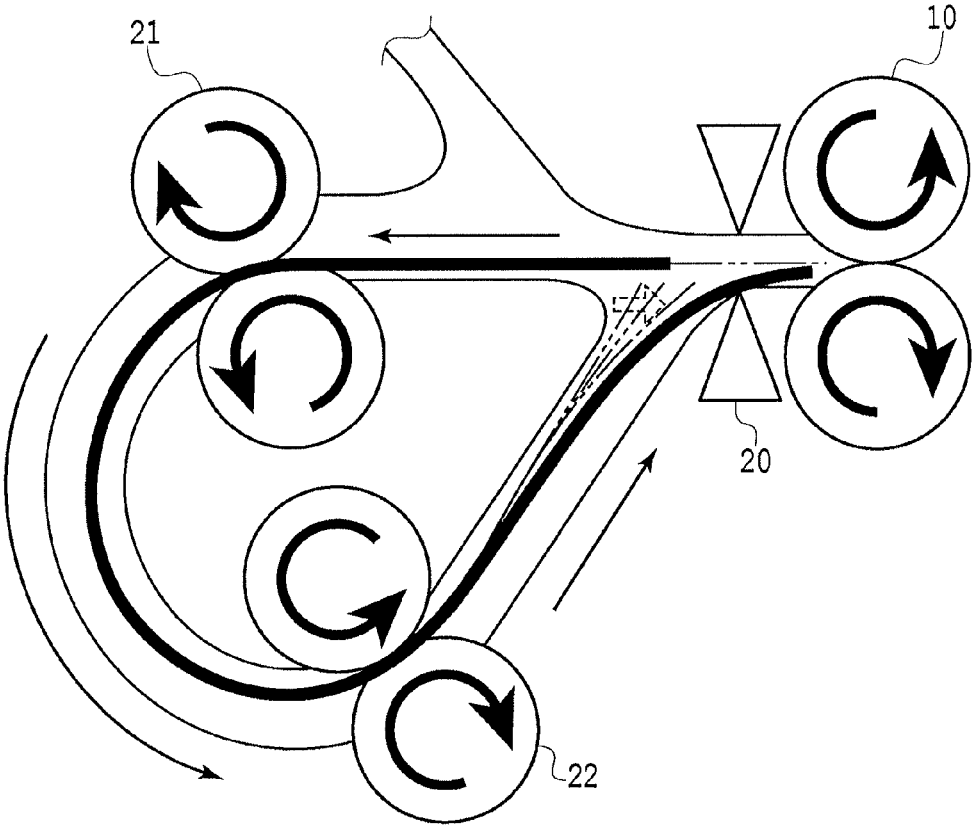
FIG. 10 is a diagram for describing reversing operation of a printing medium in the printing apparatus according to the first embodiment.

Thus, even when the fore end of the printing medium P jostles with its back end surface so the conveyance is prevented and the driving motor is overloaded, suspending the motor and conveyance of the printing medium lowers slightly downward the fore end in the gravity direction as illustrated in FIG. 10 (depending on the printing medium's characteristic, it will come to one of the situations as illustrated by the dashed lines. The printing medium illustrated by the solid line is assumed to be relatively soft medium) so that the fore end can be separated from the back end surface. This removes the contact of the fore end and back end surface of the printing medium and the cause of overloading the driving motor, so that normal conveyance operation can be performed afterwards. The continued conveyance of the printing medium can transfer its fore end to the PE sensor, enabling the continued printing on the back surface (second surface).

Note that, though not shown in the diagram, the drive source of the rollers such as the conveying roller and reversing roller is configured as a single driving motor within the printing apparatus according to this embodiment in view of downsizing and cost reduction. The operation of each roller performed by the single drive source is driven and transferred by known structures to control normal rotation, reverse rotation, non-rotation, and the like.

Again with reference to FIGS. 9A and 9B, it is determined whether or not servo errors have occurred after restarting the rotation of the motor (step S309). In this case, if any servo error has occurred, which means the cause of driving load is not removed, it is determined that a paper jam have occurred, followed by stopping the motor (step S312), notifying the a paper jam error (step S313), and terminating the apparatus with error.

On the other hand, if it is determined that no servo error has occurred, suspending the driving motor at step S306 will change the status of the fore end of the printing medium, removing a load on the motor that prevents conveying the printing medium. As a result, continuing the conveyance transfers the fore end of the printing medium to the PE sensor 20. Then, if it is determined, by the PE sensor 20 detecting the printing medium, that the printing medium has reached the position for switching the rotation of the conveying motor to the normal rotation (step S310), the rotation is switched from reverse rotation to normal rotation (step S311), terminating the apparatus with no error.

Figure 11:
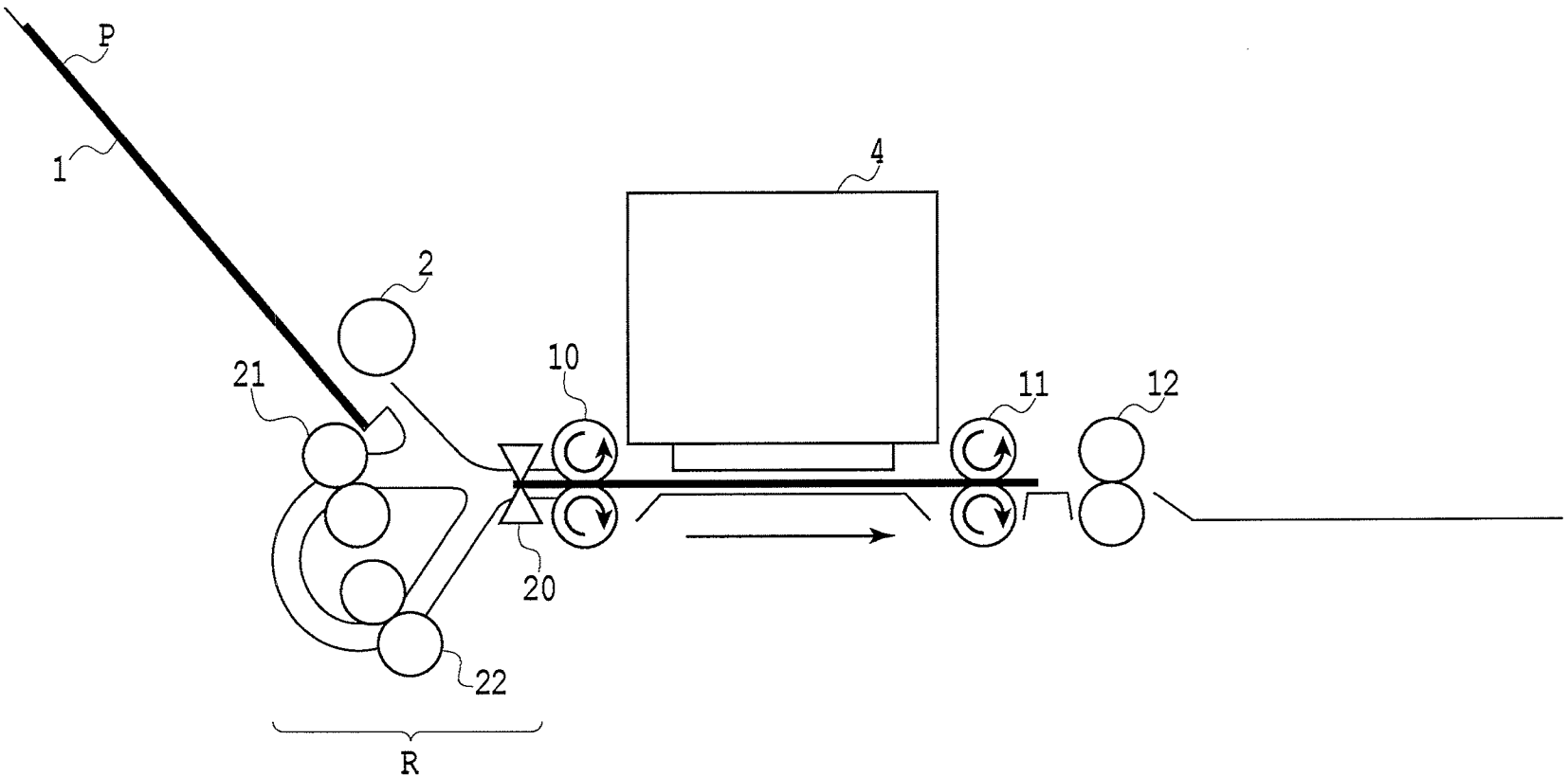
FIG. 11 is a diagram for describing reversing operation of a printing medium in the printing apparatus according to the first embodiment.
Figure 12:
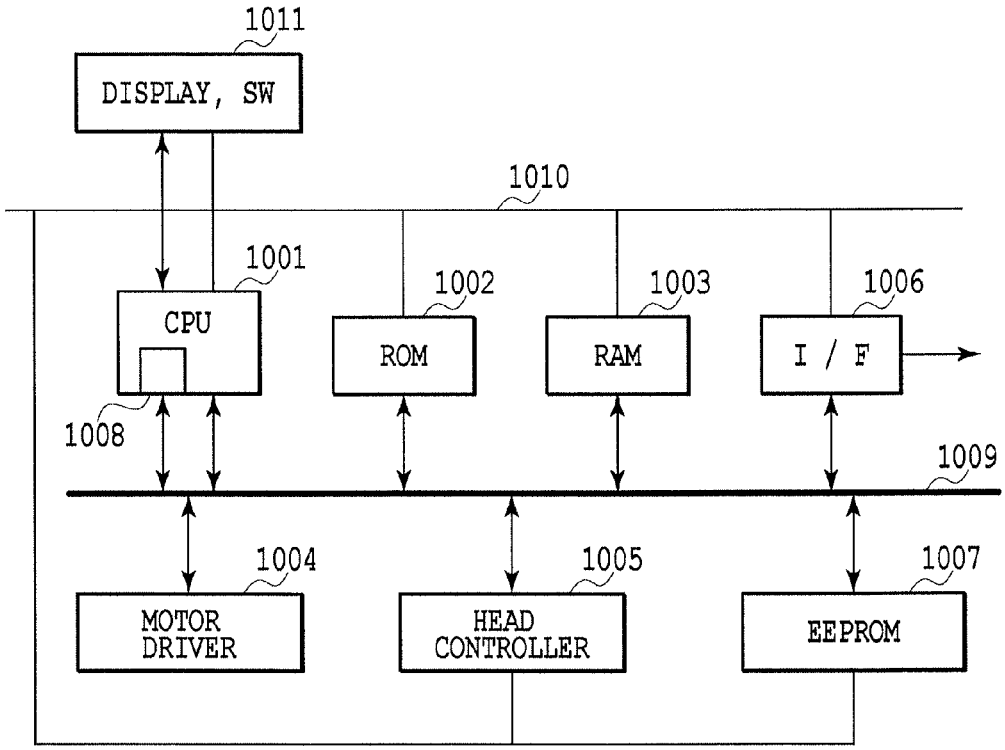
FIG. 12 is a block diagram illustrating the control of the printing apparatus according to the first embodiment.

As illustrated in FIG. 11, the printing is performed on the second surface (back surface) of the printing medium and the printing medium is discharged to the discharge tray.

As described above, in this embodiment, even when a motor for driving a conveying roller and reversing roller is overloaded and servo errors are detected, the position of the detected fore end of the printing medium is compared with a threshold, and if the position is larger than the threshold, the conveyance by the reversing roller is suspended before determining a paper jam has occurred. This lowers slightly downward the fore end in the gravity direction so that the contact of the fore end of the printing medium on its back end surface (back end area) can be removed. As a result, the contact of the fore end of the printing medium on its back end surface is removes and the printing medium is normally transferred to the PE sensor.

In other words, in this embodiment, when servo errors have occurred during reversing the printing medium, it can be determined based on the position of the fore end of the printing medium whether only a sliding load has increased on the fore end and back end passing each other or a paper jam has occurred. If only the fore end and back end pass each other, the suspending and restarting of the conveyance operation can accomplish normal conveyance. As a result, paper jam errors can be avoided when operation can be continued without any complicated structures.

FIG. 12 is a block diagram illustrating the control of the printing apparatus according to the embodiment. The bus line 1009 transfers address signals, control signals, and data within the printing apparatus. The CPU 1001 controls the entire printing apparatus based on various programs such as conveyance control programs deployed from the ROM 1002 to the ROM 1003 as described below with reference to FIG. 12. The ROM 1002 stores an error handling program, printing program, and other programs for operating the CPU 1001. The display 1011 includes a function for instructing an operator to perform a next operation based on instructions from the CPU 1001 or input from an operating part (not shown), and a function for notifying any error. The CPU 1001 appropriately instructs the motor driver 1004 to drive the conveying motor and carriage motor in a synchronized manner. The interface 1006 processes image data input via the communication controller. The processed data is transferred to the printing head by the head controller 1005, where the data is printed. The EEPROM 1107 is a non-volatile ROM, which allows data to be erased or rewritten.

Second Embodiment

For the first embodiment, when the motor is overloaded and servo errors occur, the operation of the motor is suspended and it is determined whether or not the position of the fore end of the second surface (back surface) of the printing medium P is larger than the threshold. If so, moving the motor again will separate the fore end of the printing medium from it's the back end, removing the force bringing back the fore end by the conveyance of the back end and enabling the normal conveyance.

According to a second embodiment, in the configuration illustrated in FIG. 8 for example, the path from the reversing roller 22 to the branch A may be gently inclined (not shown). That is, the path is more horizontal than in the first embodiment.

According to the configuration, the printing medium P can be more horizontally conveyed to the branch A than in the first embodiment. In this case, as the fore end of the printing medium P more loosely contacts on its back end surface than in the first embodiment, the fore end of the printing medium more loosely contacts on its back end surface even when any servo error has occurred, by further driving the driving motor and forcibly conveying and moving the printing medium, frictions due to the contact can be removed, so that the printing medium can reach the PE sensor.

On the other hand, if servo errors are still not resolved even by continuing to operate the reversing rollers 21 and 22, the conveying roller may be stopped by stopping the motor, notifying a paper jam error.

As described above, when any servo error has occurred during reversing the printing medium, it can be determined based on the position of the fore end of the back surface of the printing medium whether only a sliding load has increased on the fore end and back end passing each other or a paper jam has occurred. If only a sliding load has increased on the fore end and back end passing each other, continuing the conveyance can accomplish normal conveyance. As a result, paper jam errors can be prevented when operation can be continued without any complicated structures.

It will be understood to a person skilled in the art that, although the printing medium reversing unit according to this embodiment has a more horizontal shape between around the reversing roller 22 and the PE sensor 20 than in the first embodiment, the invention is not limited to such a configuration. Thus, the conveyance path may be designed in view of rigidity of the printing medium such that when servo errors have occurred, the contact of the fore end and back end area of the printing medium can be removed without suspending the conveying of the printing medium.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-179782, filed Aug. 19, 2011, which is hereby incorporated by reference herein in its entirety.

What is claimed is:

1. A printing apparatus to perform printing on a printing medium, comprising:

a reversing unit that reverses the printing medium to perform two-sided printing, and is provided with a roller for conveying the printing medium through a loop path for reversing, wherein the loop path has a shape which allows the printing medium fed from an entrance of the loop path to be looped back to the entrance;

a sensor that detects an end of the printing medium at a position in a vicinity of the entrance of the loop path;

a detecting unit configured to, when the printing medium is conveyed through the loop path, detect an overload for conveyance, and a control unit configured to perform control such that, the roller stops rotation for reversing when the detecting unit detects the overload , the control unit determines whether a counting value of an encoder for conveyance control indicating a conveyance amount of the printing medium after the sensor has detected the end reaches a threshold that is set according to a length of the loop path, and the roller resumes rotation for reversing in a case where the counting value reaches the threshold, whereas the roller does not resume rotation for reversing in a case where the counting value does not reach the threshold.

2. The printing apparatus according to claim 1, wherein a conveying roller for conveying the printing medium is provided before the entrance and the encoder generates pulses in accordance with the rotation of the conveying roller, and wherein the control unit controls the conveying roller to reverse the rotation thereof upon detection by the sensor that the rear end of the printing medium fed into the loop path has passed the conveying roller.

3. The printing apparatus according to claim 1, wherein in a case where the conveyance amount does not reach the threshold, the control unit notifies an operator of occurrence of a paper jam error.

4. The printing apparatus according to claim 1, wherein in a case where the detecting unit detects the overload after the roller has resumed rotation, the control unit notifies the operator of occurrence of a paper jam error.

5. The printing apparatus according to claim 1, wherein the loop path has a shape which allows the printing medium fed from the entrance of the loop path to be looped downward to be conveyed in a diagonally upward direction back to the entrance.

* * * * *